United States Patent [19]

Nakano

[11] 4,156,409

[45] May 29, 1979

[54] V-SHAPED FORCED AIR COOLING 4-CYCLE ENGINE

[75] Inventor: Keiichi Nakano, Sakai, Japan

[73] Assignee: Kubota, Ltd., Osaka, Japan

[21] Appl. No.: 788,881

[22] Filed: Apr. 19, 1977

[30] Foreign Application Priority Data

Jan. 24, 1977 [JP] Japan ..... 52-7142

[51] Int. Cl.[2] ..... F01P 5/06

[52] U.S. Cl. ..... 123/41.65; 123/55 VE; 123/195 C; 123/192 B

[58] Field of Search ..... 123/41.65, 41.6, 41.69, 123/55 V, 55 VE, 55 VS, 55 VF, 52 MC, 108, 195 A, 41.67, 195 C, 192 B

[56] References Cited

U.S. PATENT DOCUMENTS

| | | | |
|---|---|---|---|
| 2,174,676 | 10/1939 | Yarian | 123/108 |
| 2,411,653 | 11/1946 | Ginn | 123/108 |
| 2,585,083 | 2/1952 | Bouvy | 123/41.65 |
| 2,632,340 | 3/1953 | Dolza et al. | 123/55 VS X |
| 2,650,578 | 9/1953 | Daub | 123/41.69 |
| 2,736,299 | 2/1956 | Medenus | 123/41.65 X |
| 2,758,580 | 8/1956 | Balzer | 123/41.65 |
| 2,902,985 | 9/1959 | Kloss | 123/41.65 X |
| 2,966,146 | 12/1960 | Schweitzer et al. | 123/41.69 X |
| 3,149,618 | 9/1964 | Catterson | 123/108 |

*Primary Examiner*—Charles J. Myhre
*Assistant Examiner*—Jeffrey L. Yates
*Attorney, Agent, or Firm*—Bacon & Thomas

[57] ABSTRACT

An engine crankcase has oppositely inclined surfaces thereon, to which cylinders equipped with cooling fins are attached, to form a V-shaped engine. The crankcase has a crankshaft rotatably mounted therein, the front end of which projects from the front of the crankcase and has a cooling fan mounted thereon, the fan being housed within a cover adapted to pass cooling air backwards over the cylinders. A cam shaft is mounted vertically above the crankshaft, and the two are connected by gears mounted at the front of the crankcase. The rear end of the V-shaped region between the cylinders is open to provide for the escape of foreign matter, and the engine is balanced by locating the governor and the lubricant pump within the rear end of the crankcase.

4 Claims, 4 Drawing Figures

V-SHAPED FORCED AIR COOLING 4-CYCLE ENGINE

BACKGROUND OF THE INVENTION

1. Field of the Invention

The present invention relates generally to air-cooled, V-shaped engines. More particularly, it relates to an improved design for such an engine, wherein the V-shaped region formed between the cylinders is cleaned of foreign matter by the flow of cooling air therethrough.

2. Description of the Prior Art

Air-cooled, V-shaped engines are known, and different designs have been proposed therefor. In the conventional engine of this type the gear arrangement for linking the camshaft for driving the valves with the crankshaft is located at the rear of the crankcase, within a gear housing that acts to close off the rear end of the V-shaped region formed between the cylinders of the engine. The V-shaped region is also normally closed off at its forward end by a cover associated with the air cooling apparatus, with the result that when foreign objects intrude into the region, such as pieces of straw and the like, they tend to remain and accumulate. This creates a danger of fire, should excessive heat from the engine ignite the foreign materials.

There is need for an air-cooled engine design that will overcome this problem, and which will provide for the automatic cleaning of debris from the V-shaped region between the cylinders. The present invention is intended to satisfy that need, and provides an engine that is unusually compact and well balanced.

SUMMARY OF THE INVENTION

In the present invention the gear arrangement for connecting the camshaft with the crankshaft is moved from its usual position at the rear of the crankcase, to a position at the front end of the crankcase behind the cooling fan and its enclosing cover. This allows the rear end of the V-shaped region between the cylinders to be left open, so that cooling air flowing over the engine is effective to automatically remove debris therefrom.

In the invention the camshaft is located directly above the crankshaft, and the two are connected by a pair of gears mounted within a gear chamber at the front of the crankcase. To counter-balance the weight thus placed at the front end of the engine, the governor and the lubricant pump of the engine are mounted within the crankcase at the rear thereof. Further, these elements are placed below the crankshaft, thus providing a low profile for the rear of the engine. The result is a well balanced, compact V-shaped engine that is free of the noted disadvantages inherent in the conventional air-cooled engine of this type.

It is an object of this invention to provide an air-cooled, V-shaped, 4-cycle engine wherein the V-shaped region between the cylinders will be kept free of debris by the flow of cooling air over the engine.

Another object of the invention is to provide a V-shaped, air-cooled engine that is unusually compact in size, and well balanced along its longitudinal axis.

Other objects and many of the attendant advantages of the invention will become readily apparent from the following Description of the Preferred Embodiment, when taken in conjunction with the accompanying drawings.

DESCRIPTION OF THE PREFERRED EMBODIMENT

Figure 1:
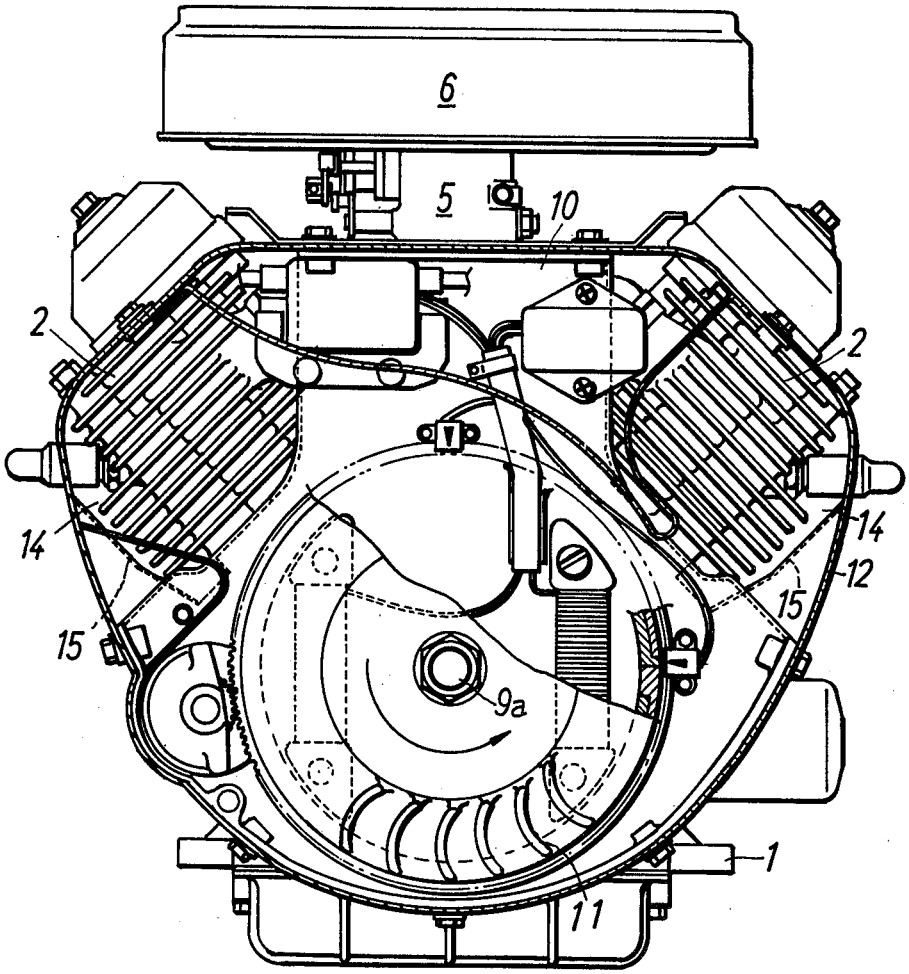
FIG. 1 is a vertical cross-sectional view taken through the cover mounted on the front end of the engine of the invention, showing the airflow passages, and the flywheel cooling fan, and the V-shaped configuration of the engine.

Referring now to the drawing, the air-cooled, V-shaped, 4-cycle engine of the invention includes a crankcase 1 having oppositely inclined, planar surfaces thereon on which cylinders 2 are secured. The cylinders 2 thus form a V-shaped region 3 therebetween, the cylinders having fins thereon to facilitate cooling thereof by moving air, and being connected by a bridging manifold inlet pipe 4. A down-draft type carburetor 5 is mounted above the manifold inlet pipe 4, and has a disc-shaped air cleaner 6 mounted thereon.

Figure 2:
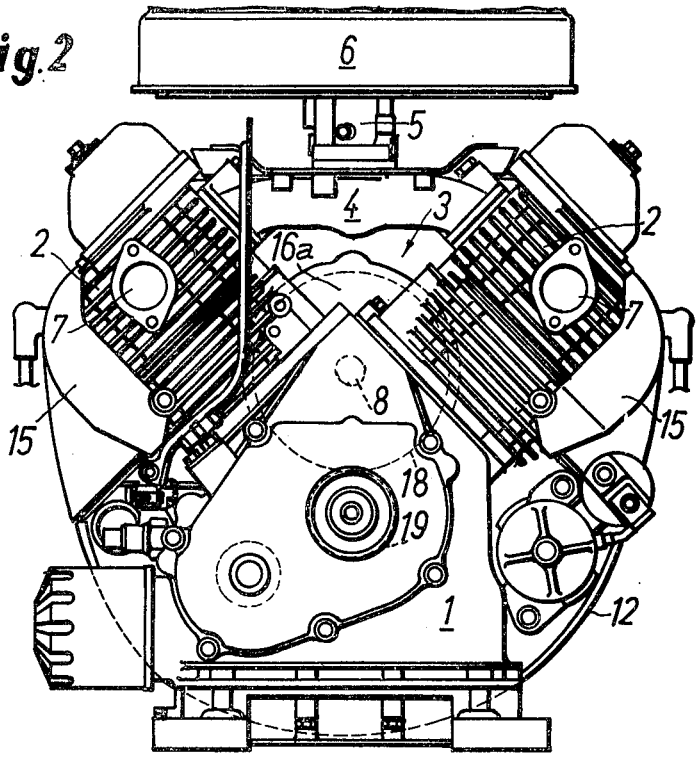
FIG. 2 is a rear elevational view of the engine of FIG. 1, showing in particular the manner in which the finned cylinders are mounted on the crankcase, and the open rear end of the V-shaped region formed between the cylinders.
Figure 3:
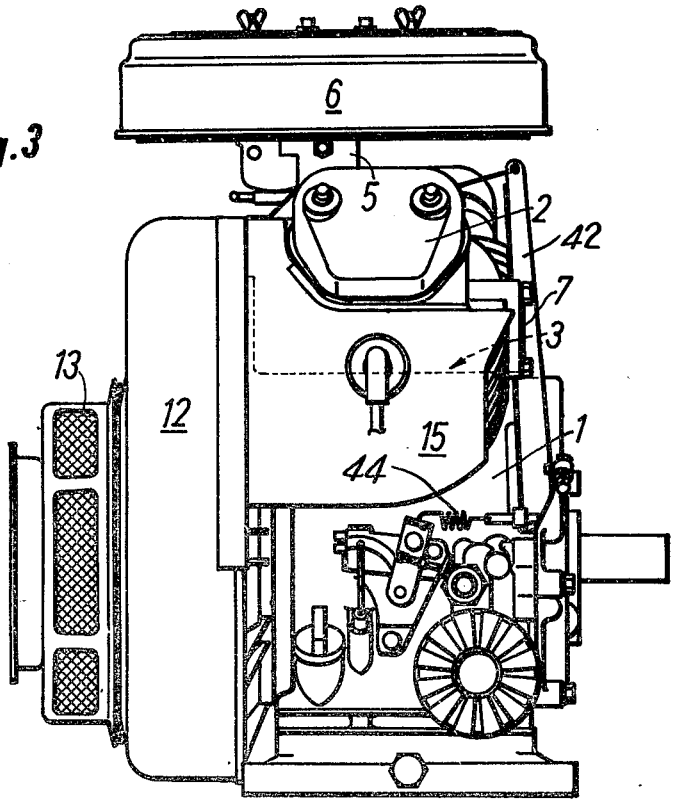
FIG. 3 is a side elevational view of the engine of FIG. 1.

Each of the cylinders 2 has an exhaust port 7 at its back, and the exhaust ports are connected to exhaust pipes (not shown) leading to a common muffler (not shown). Referring to FIG. 2, the exhaust pipes and the muffler are preferably placed to lie below the exhaust ports 7 and the peak of the inverted V formed by the oppositely inclined planar surfaces of the crankcase, so as not to block the rear opening leading from the V-shaped region 3 between the cylinders 2.

Figure 4:
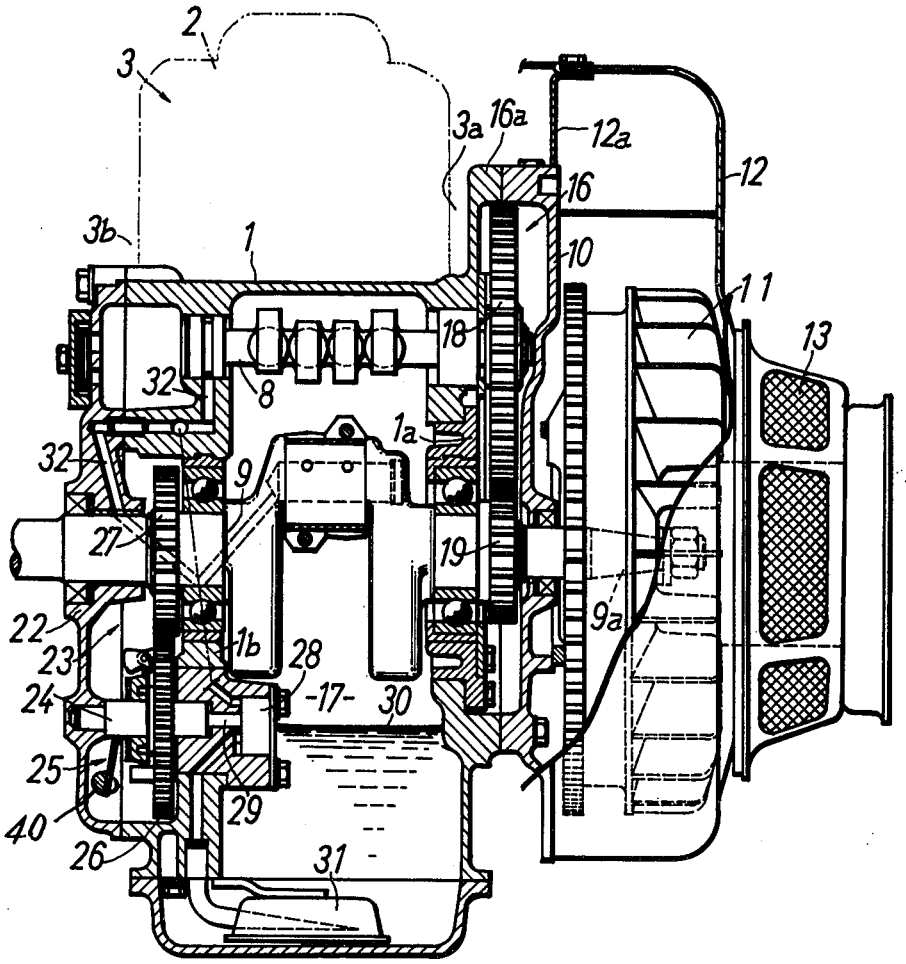
FIG. 4 is a vertical sectional view taken through the longitudinal axis of the engine of FIG. 1 and showing the construction of the interior of the crankcase, the right hand cylinder being shown by phantom lines for purposes of clarity.

Referring now to FIG. 4, the crankcase contains a main chamber 17, which is bridged by an axially extending, rotatably mounted crankshaft 9, the front end portion **9*a* of which projects through the removable front plate 10 of the crankcase and has a flywheel cooling fan 11 mounted thereon. The flywheel cooling fan 11 is enclosed by a cover 12, which has a screened inlet opening 13 centrally thereof for admitting cooling air. As shown in FIG. 1, the rear of the cover 12 has two outlet openings 14 therein, one on each side of the engine in alignment with the finned cylinders 2. Arcuate, elongated enclosures 15 extend rearwardly toward the cylinders 2 from the openings 14, and serve to guide cooling air over the fins on the cylinders, the cooling air escaping into the V-shaped region 3 and flowing rearwardly from the cylinders and the crankcase.The cooling fan 11** ensures the forced movement of cooling air through the engine.

The engine includes a camshaft 8 for operating the engine valves (not shown), the camshaft being journaled in bearings mounted within openings provided in the crankcase 1, and lying directly above the crankshaft 9 in a common vertical plane. The camshaft 8 is operable to effect opening and closing of the inlet and exhaust valves of the cylinders 2, in a known manner.

A gear chamber 16 is formed in the forward end of the chamber 17 between the front wall **1*a* of the crankcase and the front plate 10. The ceiling 16a of the chamber 16 projects upwardly to partially block the front end of the V-shaped region 3, but this is not material since the cover 12 will normally extend even further in a vertical direction. Meshed gears 18 and 19 are received in the gear chamber 16 and are carried by the camshaft 8 and the crankshaft 9**, the gears serving to mechanically link the two shafts.

With the arrangement shown, it will be seen that the rear end of the V-shaped region 3 remains open and unobstructed, as is perhaps best understood from FIG. 4. Thus, any debris entering the region 3 is free to move out the open rear end thereof, and such removal of debris is effected by the forced flow of cooling air from the finned cylinders 2 and over the engine, driven by the cooling fan 11.

Because the gears 18 and 19 have been placed at the front of the crankcase 1, the center of gravity of the engine is inclined toward the front. To remedy this unbalance, the governor 25 and the lubricant pump 28 of the engine are located at the back of the crankcase. Moreover, in order to keep the rear of the V-shaped region 3 open and to provide a compact engine configuration, the governor 25 and the lubricant pump 28 are disposed below the crankshaft 9.

The governor 25 functions in the usual manner for such small internal combustion engines to adjust the position of the engine throttle for maintaining a predetermined speed of crankshaft rotation, and is mounted on a governor shaft 24 housed in a governor chamber 23 formed in the crankcase 1 beneath the crankshaft 9, which chamber constitutes a rearward extension of the main crankcase chamber 17. A governor gear 26 is secured to the governor shaft 24, and is driven by a gear 27 from the crankshaft 9. In front of the governor gear 26 the lubricant pump 28 is mounted, located such that it is thrust forwardly into the main chamber 17 of the crankcase. The pump has a shaft 29, which is an extension of the governor shaft 24, and receives a constant flow of lubricant 30 from the bottom of the chamber 17. The lubricant 30 is pumped to a strainer 31, and thence to the crankshaft 9, the valve-driving camshaft 8, and the other moving parts, through oil passages 32.

The construction details of the governor 25 are not important to the present invention, and thus such are not presented herein. The principles for constructing such engine governors are well known, as demonstrated by U.S. Pat. Nos. 2,758,580 and 3,149,618, both of which disclose governors generally like that utilized herein. Such governors employ flyweights that are moved outwardly by centrifugal force in response to engine rotation, this outward movement being utilized through a linkage mechanism to control the position of the engine carburetor or throttle assembly. In the drawings, a centrifugal flyweight is shown at 40, and is connected to the carburetor 5 by a governor lever 42 biased by a spring 44, all in the usual manner. As engine speed is increased, the flyweights 40 are moved by centrifugal force to decrease the flow of fuel through the carburetor, and the speed of the engine is controlled.

It will be seen from the foregoing description of the invention and an examination of the drawings that an unusually compact engine has been provided, in which balance longitudinally of the engine is maintained by counterbalancing the weight of the driving gears 18 and 19 for linking the crankshaft 19 and the camshaft 8, with the governor 25, the lubricant pump 28, and their driving gears 26 and 27. The V-shaped region 3 between the cylinders 2 is left open at its rear, so that debris occurring in the region can be easily removed by the flow of cooling air over the engine. Thus, the objects hereinabove set forth have been attained.

Obviously, modifications and variations of the invention are possible.

What is claimed is:

1. A V-shaped, air-cooled engine, comprising:

a crankcase;

cylinder means mounted on said crankcase, and defining a V-shaped region therebetween, said cylinder means having cooling fins thereon;

means for supplying fuel to said cylinder means, including carburetor means;

a crankshaft rotatably mounted within said crankcase to extend axially thereof, said crankshaft being mounted centrally of the height of said crankcase and including a front end portion that projects through the front end of said crankcase;

a flywheel cooling fan mounted on said projecting portion of said crankshaft;

cover means secured to the front of said crankcase and enclosing said cooling fan, said cover means being arranged to direct cooling airflow rearwardly past the fins on said cylinder means and through said V-shaped region;

a camshaft mounted within said crankcase above said crankshaft;

means defining a gear chamber at the front end of said crankcase rearwardly of said cover means;

a first gear received within said gear chamber at the front end of said crankcase and mounted on said crankshaft;

a second gear also received within said gear chamber at the front end of said crankcase and mounted on said camshaft, said second gear being in mesh with said first gear to drivingly connect said camshaft with said crankshaft;

governor means mounted within said crankcase at the rear end thereof below said crankshaft, for controlling the position of said carburetor means;

a lubricant pump also mounted within said crankcase at the rear end thereof below said crankshaft, and in alignment with said governor means;

common drive shaft means connected at its opposite ends to said lubricant pump and said governor means, and extending therebetween;

a third gear mounted on said common drive shaft means between said lubricant pump and said governor means;

a fourth gear mounted on said crankshaft and located at the rear end of said crankcase, said fourth gear being in mesh with said third gear for drivingly connecting said governor means and said lubricant pump with said crankshaft, whereby said governor means, said lubricant pump, and said third and fourth gears are arranged to counterbalance said first and second gears.

2. A V-shaped, air-cooled engine as recited in claim 1, wherein the rear end of said V-shaped region is open, thereby enabling intruded foreign materials to be discharged from said region by cooling air flowing over said engine.

3. A V-shaped, air-cooled engine as recited in claim 2, wherein said gear chamber at the front end of said crankcase is partially contained in the front face of said crankcase, and partially contained in a front plate detachably secured to the front face of said crankcase, said cover means being secured to said front plate.

4. A V-shaped, air-cooled engine as recited in claim 1, wherein said crankshaft and said camshaft lie in a common vertical plane.

* * * * *